US007716765B1

(12) United States Patent
Lakov

(10) Patent No.: US 7,716,765 B1
(45) Date of Patent: May 18, 2010

(54) COMBINATION MATTRESS WITH A REMOVABLE BABY-CARRYING PIECE

(76) Inventor: Peter L. Lakov, 424 102nd Ave. SE., #202, Bellevue, WA (US) 98004

( * ) Notice: Subject to any disclaimer, the term of this patent is extended or adjusted under 35 U.S.C. 154(b) by 0 days.

(21) Appl. No.: 12/425,801

(22) Filed: Apr. 17, 2009

(51) Int. Cl.
*A47D 13/02* (2006.01)
*A47C 27/14* (2006.01)

(52) U.S. Cl. ..... 5/655; 5/722; 5/730

(58) Field of Classification Search ..... 5/701, 5/722, 723, 730, 694, 655
See application file for complete search history.

(56) References Cited

U.S. PATENT DOCUMENTS

| | | | | | |
|---|---|---|---|---|---|
| 2,615,175 | A * | 10/1952 | Corakas | 4/456 |
| 3,146,469 | A * | 9/1964 | Slade | 5/695 |
| 5,224,637 | A * | 7/1993 | Colombo | 224/159 |
| 5,261,134 | A | 11/1993 | Matthews | |
| 5,400,449 | A * | 3/1995 | Satto | 5/631 |
| 5,581,833 | A * | 12/1996 | Zenoff | 5/655 |
| 5,947,557 | A | 9/1999 | Bellefleur | |
| 6,061,854 | A * | 5/2000 | Crowley | 5/655 |
| 6,243,898 | B1 * | 6/2001 | Ruff | 5/695 |
| 6,581,229 | B2 * | 6/2003 | Bernstein | 5/722 |
| 6,854,144 | B1 * | 2/2005 | Mehring, Jr. | 5/727 |
| 7,454,808 | B2 | 11/2008 | Parrilla | |
| 2006/0179575 | A1 * | 8/2006 | Goodwin et al. | 5/655 |

* cited by examiner

*Primary Examiner*—Michael Trettel
(74) *Attorney, Agent, or Firm*—Pai Patent & Trademark Law Firm; Chao-Chang David Pai

(57) ABSTRACT

A combination mattress for putting babies to sleep without disturbing the babies and waking them up includes a platform piece and baby-carrying piece. When the baby-carrying piece is placed in the platform piece, the two form a complete sleeping surface for a baby. When the caregiver needs to put the baby to sleep, the caregiver removes the baby-carrying piece from the platform piece, puts the baby on top of the baby-carrying piece, and cuddles the baby to sleep. When the baby is asleep, the caregiver moves the baby-carrying piece with the baby lying on top of the baby-carrying piece into the platform piece, where the baby continues to sleep. By avoiding touching the baby or creating pressure points with the baby's body, the caregiver avoids waking up the baby while transporting the baby to the platform piece.

17 Claims, 6 Drawing Sheets

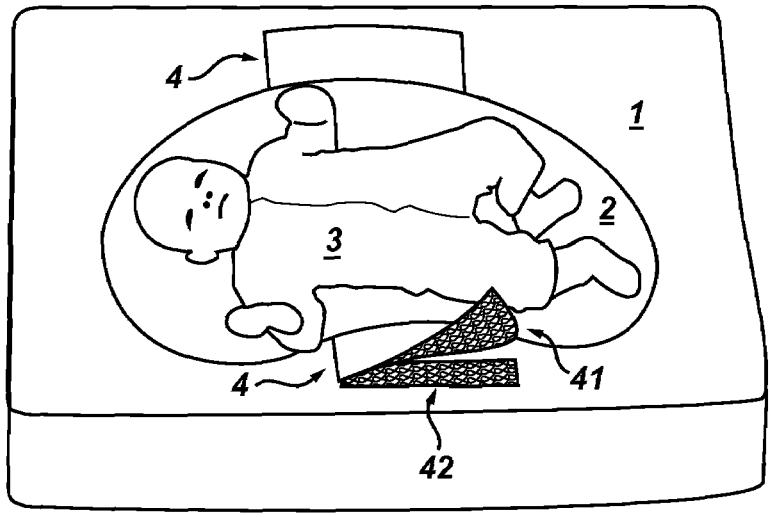
Fig. 3
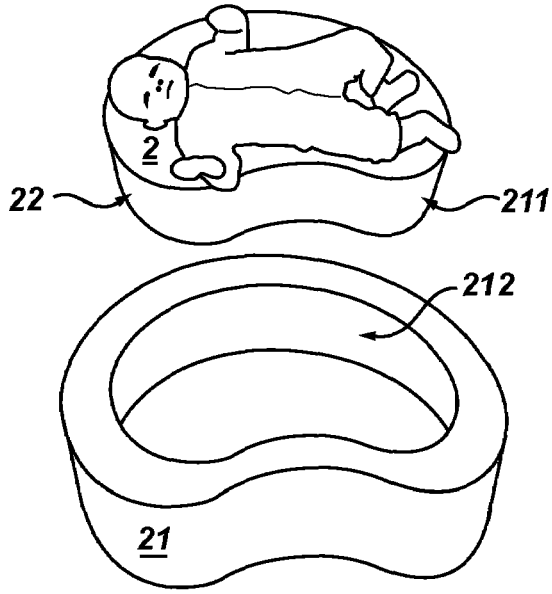
Fig. 4
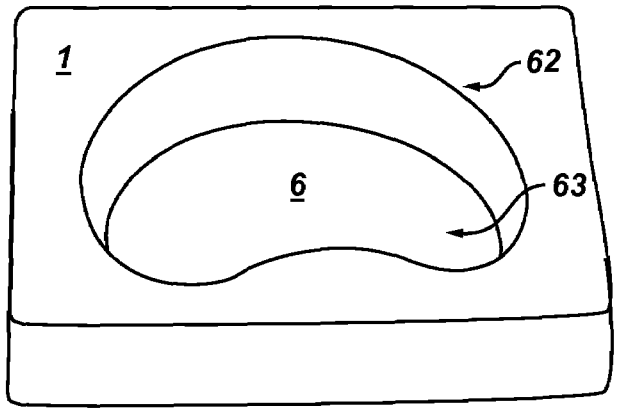

COMBINATION MATTRESS WITH A REMOVABLE BABY-CARRYING PIECE

BACKGROUND OF THE INVENTION

1. Field of the Invention

The present invention relates to baby mattresses and more particularly to baby mattresses having a removable baby-carrying piece, which can be used to hold a baby and placed to the mattress with the baby without disturbing or waking up the baby.

2. Description of the Related Art

Babies (including newborns—from 0 to 6 weeks of age and infants—from 6 weeks to 1 year of age) need body contact with a parent or other caregiver (thereafter "caregiver") in order to feel safe. As many caregivers would testify, one of the fastest ways to put a baby to sleep is to hold the baby in one's arms and rock the baby back and forth. This may be explained with the utmost proximity between baby and the caregiver, the warmth of the caregiver's body, the heart beat of the caregiver's body, etc.

Trying to put a baby to sleep by placing the baby in a bassinet and rocking the bassinet back and forth is usually met with more resistance and cries from the baby compared to holding the baby in one's arms, even if the caregiver is right over the bassinet, since the baby feels an increased distance from the caregiver's body.

Trying to put a baby to sleep by placing the baby in a crib is even more difficult and met with even more resistance from the baby and could take much longer, since the baby feels even more isolated.

As a result, when putting the baby to sleep, many caregivers would prefer to hold the baby in their arms and rock the baby back and forth (or from side to side), and when the baby falls asleep place the baby in a bassinet or a crib and then leave the baby asleep.

Since babies usually need to be put to sleep between 6 to 10 times per day (or between 1000 and 2000 or more times for the first six months), holding the baby in one's arms can be tiring for the caregiver and can lead to muscle stress, problems and/or injuries in the back, neck, shoulders, and other unwanted symptoms.

To alleviate these problems, a number of devices can be used, such as the "Boppy Nursing Pillow" (U.S. Pat. No. 5,261,134), the "Brest Friend" (U.S. Pat. No. 7,454,808), or a regular pillow. In order to put the baby to sleep using these devices, the caregiver can sit in a rocking chair (such as described in U.S. Pat. No. 5,947,557), put the Boppy, the Brest Friend, or the pillow on their knees, place the baby on top, and while holding the baby—lest the baby rolls off the device—rocks back and forth until the baby falls asleep. The benefit of using these devices is that the caregiver is not supporting the weight of the baby with their arms. Instead, the weight of the baby falls on the knees and in the lap of the caregiver. Also, because these devices will create a surface that is higher than the knees of the caregiver, the baby lies further up, closer to the chest of the caregiver, and the caregiver does not need to lean forwards to cuddle the baby, thus avoiding potential back problems. In fact, the usage of these devices is not absolutely required in order to put a baby to sleep; instead, the caregiver could use with similar success a regular pillow, a small sleeping pad, a small changing pad, or other devices that could elevate the baby and create a surface that is flat and sufficiently firm for the baby to fall asleep comfortably while in the caregiver's lap.

A problem using all of these devices comes when the baby finally falls asleep and the caregiver decides to move the baby to a bassinet or a crib, so that the baby can continue to sleep unattended while the caregiver does something else. The problem is that in order to place the baby in a crib or a bassinet, the caregiver needs to somehow lift the baby from this position, move the baby to the crib, and lay the baby in the crib without waking the baby up. When trying to lift the baby, the caregiver usually would create pressures in the baby's body that did not exist while the baby was sleeping. This would frequently cause the baby to wake up and to start crying.

For example, the common—and perhaps the most non-obtrusive—way that caregivers could attempt to lift the baby would be by placing one palm under the baby's head and neck, while placing the second palm under the baby's bottom and lower back and then lift the baby. However, even this seemingly innocuous procedure could provide too much stimulus for the baby and cause the baby to wake up, since placing the palms under the baby creates pressure points between the baby's head and the palm, or between the baby's bottom and the palm—which are different than the pressure points between the lying baby and the Boppy (in case a Boppy was used for the purpose). Also, even if the baby does not wake up while the caregiver is lifting the baby from the Boppy, the baby would likely wake up when the caregiver attempts to place him or her in the crib. Likewise, attempting to lift the baby by placing the palms under the baby's armpits will frequently wake up the baby.

SUMMARY OF THE INVENTION

The present invention solves the afore-mentioned problems by providing an innovative combination mattress with a removable baby-carrying piece. The combination mattress comprises a platform piece with a recess, which can be a through hole, and a baby-carrying piece which fits into the recess of the platform piece to form a complete and convenient sleeping surface. The platform piece is usually placed in the crib, but it can be placed anywhere else suitable for babies to sleep on. When the caregiver needs to put the baby to sleep, the caregiver places the baby on the baby-carrying piece, holds the baby-carrying piece in his or her hands or lap, and rocks the baby to sleep. The caregiver can do this while standing, walking around, or even sitting in a chair, preferably a rocking chair. When the baby is asleep, the caregiver places the baby-carrying piece with the baby in the recess of the platform piece and the baby continues to sleep. As the caregiver is moving the baby to the crib, the caregiver does not apply pressure on the baby directly since the caregiver lifts the baby-carrying piece on which the baby sleeps, not the baby directly. This makes it less likely that the baby would wake up while the caregiver places the baby-carrying piece in the recess of the platform piece.

When the baby-carrying piece is placed in the recess of the platform piece, the resulting surface becomes a flat sleeping surface suitable for a baby to sleep on, as good and convenient as sleeping surfaces which are currently being sold, such as mattresses or sleeping pads (usually made of foam rubber or other materials suitable for baby sleeping surfaces). In describing the present invention, the term "mattress" is used in a broad sense to include all kinds of mattresses, generally understood as a flexible case filled with springs, straws, cottons, downs, feathers, foam rubber, any other similar materials, or a combination thereof.

FIG. 1 illustrates the basic invention, with the baby-carrying piece 2 outside the platform piece 1, and with the baby 3 placed on top of the baby-carrying piece 2.

We expect that commercially successful embodiments of this invention will further benefit from one or more of the following features (described in more details later):

- Contoured shape of the baby-carrying piece such that it fits comfortably around the caregiver's body
- Water impenetrable cover of the sleeping surface
- Removable fitted sheets for the platform piece and the baby-carrying piece
- Specific fabrics for the side surfaces of the platform piece and the baby-carrying piece that allow easy sliding
- Fitted sheets with extended flexible flaps for the baby-carrying piece which the caregiver could grasp; VELCRO™ (namely hook and loop fastener) under the extended flexible flaps for attaching to the platform piece
- Bottom of the baby-carrying piece made of a layer of firm material
- Baby-carrying piece which is formed of 2 pieces to be used in two sizes
- Gaps around or handles on the baby-carrying piece to make it easier for the caregiver to hold
- Baby-carrying piece which is bigger than the platform piece
- Belt around the baby-carrying piece to attach the baby-carrying piece around the caregiver's body
- Strap mechanism to prevent the baby from rolling off the baby-carrying piece

BRIEF DESCRIPTION OF THE DRAWINGS

The present invention can be best understood by referring to the following detailed description of the preferred embodiments in view of the accompanying drawings, wherein

FIG. 3 illustrates an embodiment which includes extended flexible flaps on the side of the fitted sheets and VELCRO™, namely hook and loop fasteners, on the underside of the flexible flaps.

FIG. 4 illustrates an embodiment with the baby-carrying piece composed of 2 pieces, allowing the size of the baby-carrying piece to be augmented when the baby grows bigger.

DETAILED DESCRIPTION OF THE PREFERRED EMBODIMENTS

Figure 1A:
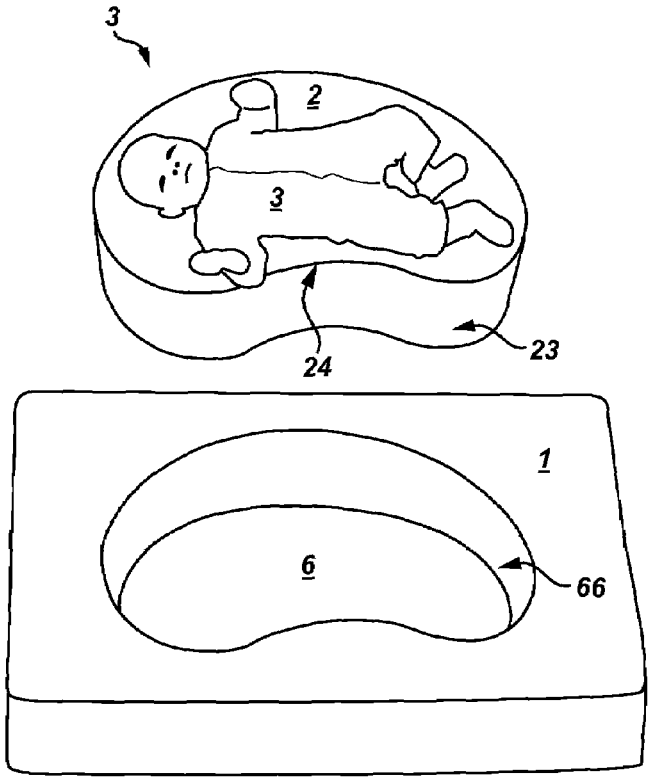
FIG. 1A illustrates an embodiment of the present invention.
Figure 1B:
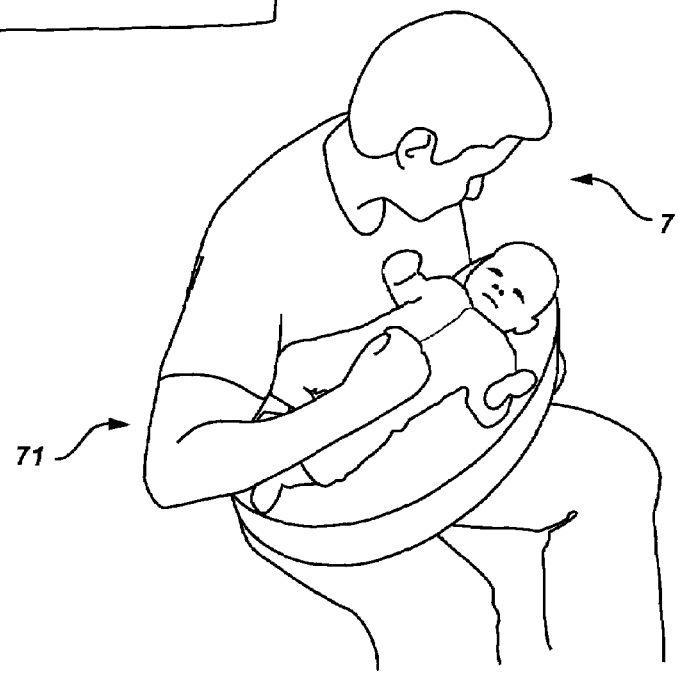
FIG. 1B illustrates a caregiver using the baby-carrying piece of the basic invention to cuddle a baby to sleep.
Figure 1C:
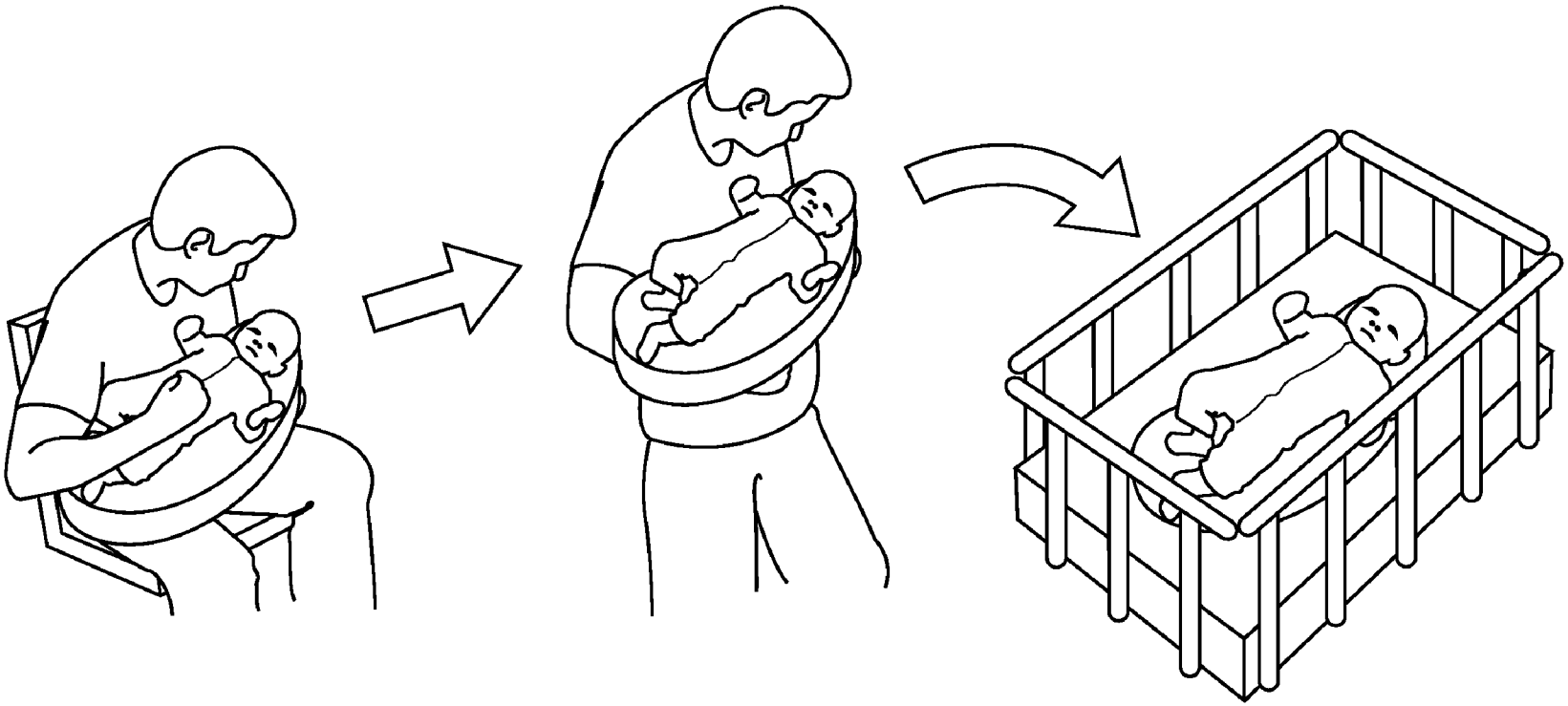
FIG. 1C illustrates the stages in putting the baby to sleep using the present invention.
Figure 2:
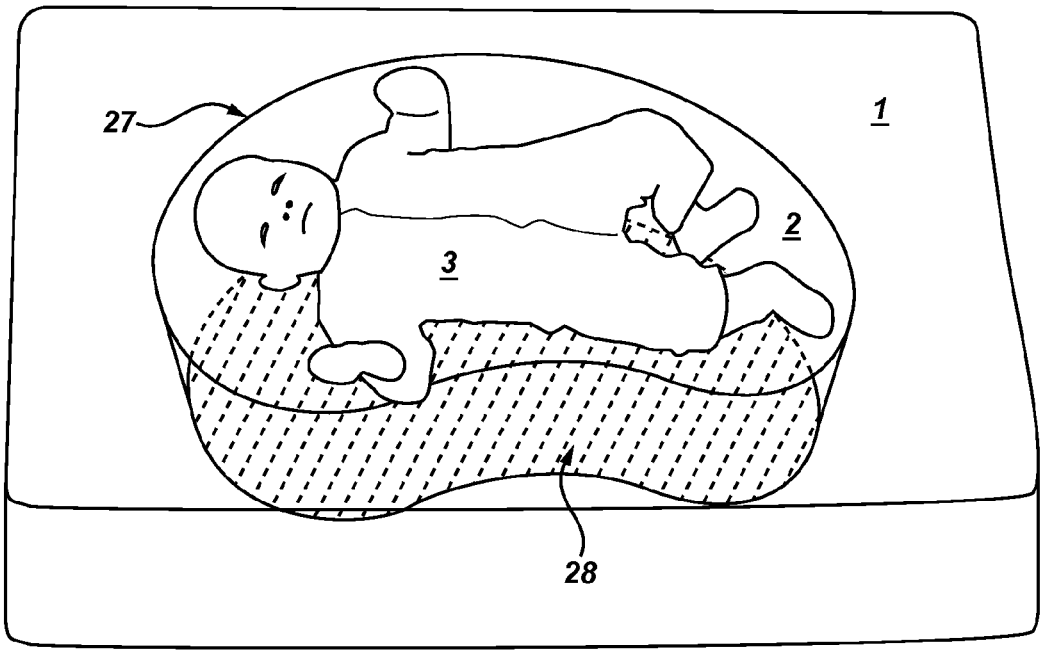
FIG. 2 illustrates the baby-carrying piece placed in the platform piece of the present invention to form a complete flat sleeping surface.

Reference is made to FIGS. 1 to 8. The simplest embodiment of this invention is a rectangular parallelepiped comprising a platform piece 1 and a baby-carrying piece 2 made of foam rubber or a similarly appropriate material for sleeping pads. The platform piece 1 has the general size of a baby sleeping pad (for example 36 inches×27 inches×3 inches) and the baby-carrying piece 2 is cut out from the parallelepiped as shown in FIG. 1A. When the caregiver needs to put the baby 3 to sleep, the caregiver would put the baby 3 on top of the baby-carrying piece 2, and, while holding the baby-carrying piece 2 (in her arms, or on her knees), could cuddle the baby 3 to sleep. Then when the baby is asleep, the caregiver would lift the baby-carrying piece 2 with the baby continuing to lie on it, and place it into the recess 6 of the platform piece 1. The baby-carrying piece 2 has to be large enough so that the baby can lie comfortably on it while the baby is being cuddled to sleep. This most basic embodiment of the invention is illustrated in FIG. 1.

In this invention, both the platform piece 1 and the baby-carrying piece 2 can each be a flexible case filled with spring coils, straws, cottons, downs, feathers, foam rubber, any other similar material, or a combination thereof. In the simplest form, they can also be a bare piece of foam rubber or other elastically firm materials.

In another embodiment, the platform piece 1 and the baby-carrying piece 2 have a special shape that would facilitate the sliding—for example having the side surfaces 23 (FIG. 1A) of the baby-carrying piece 2 and platform piece 1 slanted at an angle, where the recess 6 of the platform piece 1 has a gradually larger circumference from the top to the bottom, and correspondingly where the baby-carrying piece 2 is gradually smaller from the top to the bottom. This way, the platform piece 1 and baby-carrying piece 2 would fit one another like a smaller cone sliding into a larger cone, and gravity would allow the sliding to occur effortlessly.

It should be noted that for ease of use, we expect that in most commercial embodiments, the baby-carrying piece 2 will have a specific shape that would facilitate the sliding into the platform piece 1. Specifically, we expect the most common shape to be one in which the top surface 27 (FIG. 2) of the baby-carrying piece 2 will be larger than the bottom surface 28 (FIG. 2) of the baby-carrying piece 2; and on the flip side, the size of the recess 6 in the platform piece 1 will be bigger at the top of the recess (item 62 on FIG. 4) than the bottom of the recess (item 63 on FIG. 4). This will facilitate the sliding of the baby-carrying piece 2 into the platform piece 1. Otherwise, if the baby-carrying piece 2 has vertical sides, and the recess 6 in the platform piece 1 has vertical sides, sliding the baby-carrying piece 2 into the platform piece 1 would become difficult for the caregiver to the point that it could cause the baby to wake up.

While the size of the platform piece 1 would depend on the size of the baby cribs or other sleeping locations where the baby may sleep, and while multiple sizes could be provided to accommodate these various needs, we expect that the size of the baby-carrying piece 2 with length 26 inches and width 13 inches could accommodate the majority of babies. Of course, other sizes could be provided as demand for them arises.

While the embodiments described above are fully working and functional, we believe a more useful product would include more of the features described in Section Summary of Invention. Those additional features are described in more detail in the following:

First, the shape of the baby-carrying piece 2 can be shaped to the contours of a person's body (item 24 on FIG. 1A), so that when the caregiver 7 places the baby-carrying piece 2 next to her torso, the baby-carrying piece 2 would fit better around the caregiver's torso 71, thus reducing the chance that the baby lying on top of the baby-carrying piece 2 might slip between the baby-carrying piece 2 and the caregiver's torso 71. FIG. 1A and most of the other figures illustrate a contoured version of the baby-carrying piece 2. However, the shape of the baby-carrying piece 2 is not limited to any particular shapes. It may be shaped as rectangle, an oval, or other appropriate shapes. We believe the contoured shape with a concave portion 24 described here will be the most convenient, and because of that most figures will illustrate the contoured version.

Second, both the platform piece 1 and the baby-carrying piece 2 can be made of material that is water impenetrable, or can be permanently covered with such water impenetrable material so that if the baby wets himself or herself, the baby-carrying piece 2 and/or the platform piece 1 are not wet in their volume, but just on their surface. This is similar to how the baby changing pads typically sold nowadays are implemented—soft padded material on the inside, covered with sewn rubberized fabric on top.

Third, a commercial offering would benefit by including removable exterior coverings (or fitted sheets) for the platform piece 1 and the baby-carrying piece 2. These sheets will allow the caregiver to remove and wash the sheets for better hygiene, as well as change the colors of the sheets for more appeal.

Fourth, a layer of thin but firm material can be glued or otherwise securely attached at the bottom of the baby-carrying piece 2 to allow the caregiver to lift the baby by holding that firm layer without bending the baby-carrying piece 2 (if the material of the sleeping pad is too soft or the baby is too heavy). For example, if the platform piece 1 and baby-carrying piece 2 are made of soft foam rubber, it may be difficult to lift the baby-carrying piece 2 without bending it by the weight of the baby and thus disturbing the sleeping baby. As observed in the prototypes we built, adding a thin ¼ inch layer of plywood at the bottom of the baby-carrying piece 2 shaped as the bottom surface of the baby-carrying piece 2 improves dramatically the stability when transporting the baby. If, however, the platform piece 1 and baby-carrying piece 2 are made of firmer materials, such as firmer foam rubber, this additional layer of firm material may be unnecessary.

Fifth, a baby-carrying piece 2 comprising of two pieces—one that is just a baby-carrying piece without a recess (item 22 on FIG. 4), and another piece with a recess (item 21 on FIG. 4)—when the smaller baby-carrying piece 22 is placed in the piece with a recess 21, the combined piece becomes a larger baby-carrying piece 2. This will allow a caregiver to increase the size of the baby-carrying piece 2 when the baby grows up (FIG. 4). If this feature is included, the materials from which the outer side surface 211 of the smaller baby-carrying piece 21 and the side surface 212 of the recess of the larger baby-carrying piece 21 may have to be chosen in such a way that that the friction between the two side surfaces, 211 and 212, would be sufficient to hold the two pieces together when the caregiver lifts the larger baby-carrying piece 2 (that is, when the baby is larger and the caregiver needs to use both baby-carrying pieces as one larger baby-carrying piece), and yet the friction is sufficiently small to allow the caregiver to easily slide the smaller baby-carrying piece 22 within the larger baby-carrying piece 2 when the baby is smaller and only the smaller baby-carrying piece 22 is needed while the baby is cuddled to sleep.

Figure 5A:
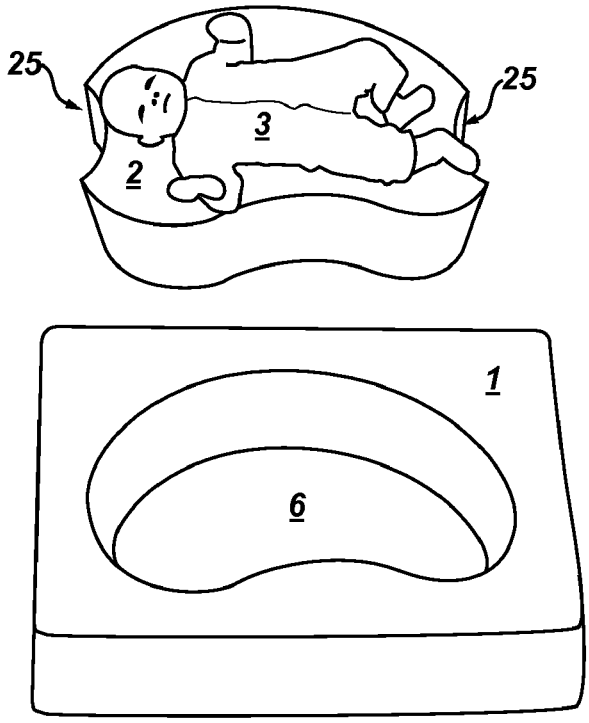
FIG. 5A illustrates an embodiment with cutouts on the baby-carrying piece to facilitate the caregiver sliding his or her palms and lifting the baby-carrying piece.
Figure 5B:
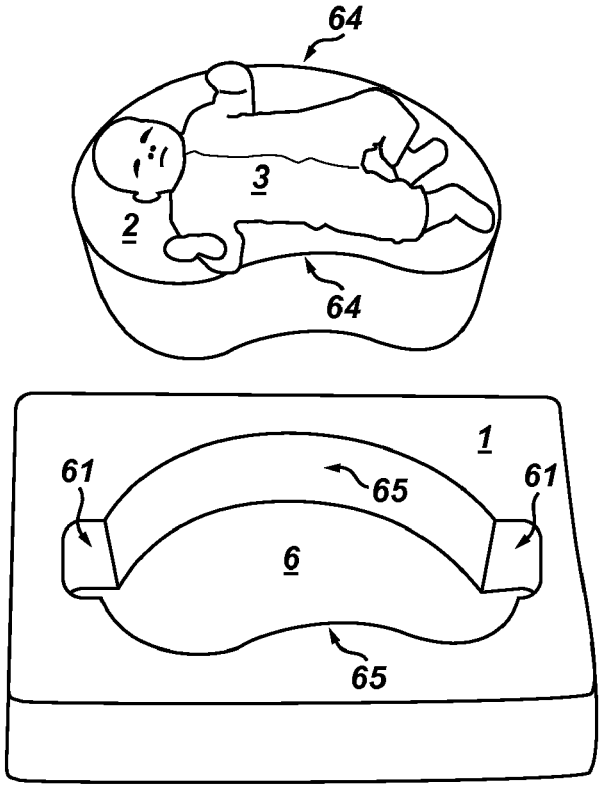
FIG. 5B illustrates an embodiment with cutouts on the platform piece to facilitate the caregiver sliding his or her palms and lifting the baby-carrying piece.

Sixth, gaps or cutouts (items 25 on FIG. 5A) or other handles at two extremes of the long side of the baby-carrying piece 2 that would allow the caregiver to slide his or her hands between the baby-carrying piece 2 and the platform piece 1 and lift the baby-carrying piece 2 more easily, perhaps as the baby is already lying on the baby-carrying piece 2 (FIG. 5A). Alternatively these gaps/cutouts (items 61 on FIG. 5B) could be made in the platform piece 1, rather than the baby-carrying piece 2 (FIG. 5B). Likewise, these gaps/cutouts could be made along the narrow sides (items 64 on FIG. 5B) of the baby-carrying piece 2 or the platform counterpart side surfaces (items 65 on FIG. 5B). Note that items 61 and 65 illustrate the location where the cutouts would be made, but do not illustrate the cutouts themselves. The cutouts will be usable even if they are just ½ inch wide and 2-4 inches long, so if removable exterior coverings are provided for the platform piece 1 and the baby-carrying piece 2, these removable coverings will not need to have a different shape than if the cutouts 25 or 61 were not implemented.

Seventh, an baby-carrying piece 2 which is bigger than the platform piece 1 (we keep calling it baby-carrying piece for consistency since this is the piece the baby sleeps on, but it could fit around the "platform" piece (FIG. 6), or perhaps the platform piece 1 would not even exist, in which case this is the second version of the invention.

In another embodiment, a belt (item 5 on FIG. 7) is disposed around the baby-carrying piece 2 to keep the baby-carrying piece 2 around the caregiver's body, for example, around the waist or the neck. The belt 5 would clip on both sides of the baby-carrying piece 2 through the clips (items 51 on FIG. 7) and their corresponding bases (items 52 on FIG. 7) which are attached to the baby-carrying piece 2, allowing the caregiver 7 to secure the baby-carrying piece 2 around the waist before picking up the baby to place it on the baby-carrying piece 2. When the baby falls asleep, the caregiver would unclip the belt 5 by unclipping items 51 from items 52, lift the baby-carrying piece 2, and place it in the platform piece 1. The bases of the clips 52 attached to the baby-carrying piece 2 should be such that they do not prevent the user from being able to place easily and without effort the baby-carrying piece 2 into the platform piece 1. Also, the belt 5 will need to be of extensible size so it can accommodate caregivers with various body types. Since there are numerous techniques for achieving a belt with adjustable length (such as the belt adjuster described in U.S. Pat. Nos. 3,725,982, 3,591,900, or in many other implementations), we will not include the details of creating such a belt.

Furthermore, a strap mechanism can be added to prevent the baby from rolling off the baby-carrying piece 2 if the caregiver inadvertently bends the baby-carrying piece 2 too much. As illustrated on FIG. 8, the strap mechanism could be a cover made of simple piece of fabric (item 8 on FIG. 8) that is attached to the edge (item 26 on FIG. 8) of the outside side surface 231 of the baby-carrying piece 2, and clips to the inside side surface 232 of the baby-carrying piece 2. The caregiver could chose to put the cover 8 over the baby before the baby has fallen asleep or after the baby has fallen asleep. What is important is that while the baby is on top of the baby-carrying piece 2 and is being transported to the platform piece 1, the cover 8 is over the baby and is securely connected to the inside side surface 23 of the baby-carrying piece 2. This will reduce the risk of the baby inadvertently rolling off the baby-carrying piece 2.

In addition to the foregoing embodiments, the following features could further improve the invention.

First, specific fabrics such as satin, silk and others may be used for the side surfaces 23 of the platform piece 1 and side surfaces 66 the baby-carrying piece 2 where the two pieces touch to minimize the friction and enable a smoother sliding of the baby-carrying piece 2 into and out of the platform piece 1.

Second, fitted sheets with slightly extended flaps 4 (FIG. 3) will allow the caregiver to grasp in order to move the baby-carrying piece 2 into and out of the platform 1. The usage of the flexible flaps 4 is as follows—when the baby falls asleep, the caregiver holds each flexible flap 4 with each hand, and lifts the baby-carrying piece 2 by holding the flexible flaps 4, rather than having his or her arms under the baby-carrying piece 2. Also, when fitted sheets are used, an embodiment could include a VELCRO™ (namely hook and fastener) with a layer of VELCRO™ hooks (item 41 in FIG. 3) securely attached (perhaps sawn) on the under side of each flexible flap 4, and a counterpart layer of VELCRO™ loops (item 42 in FIG. 3) securely attached (perhaps sawn) on the respective areas of the platform piece 1. That way, when the caregiver moves the baby-carrying piece 2 with the baby to the platform piece 1, the caregiver would gently press the flexible flaps 4 to the locations of the platform piece 1 with the VELCRO™ loops 42, and the flexible flaps 4 would be secured. The hoops and loops could also be positioned in a reverse manner—the loops attached to the underside of the flexible flaps 4, and the hoops attached to the platform piece 1. That feature of the invention could prevent babies from tangling themselves in the flexible flaps 4 if those were let loose around.

Figure 6:
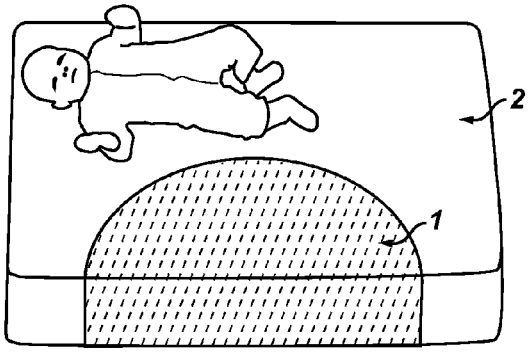
FIG. 6 illustrates an embodiment where the baby-carrying piece is larger than the platform piece.
Figure 7:
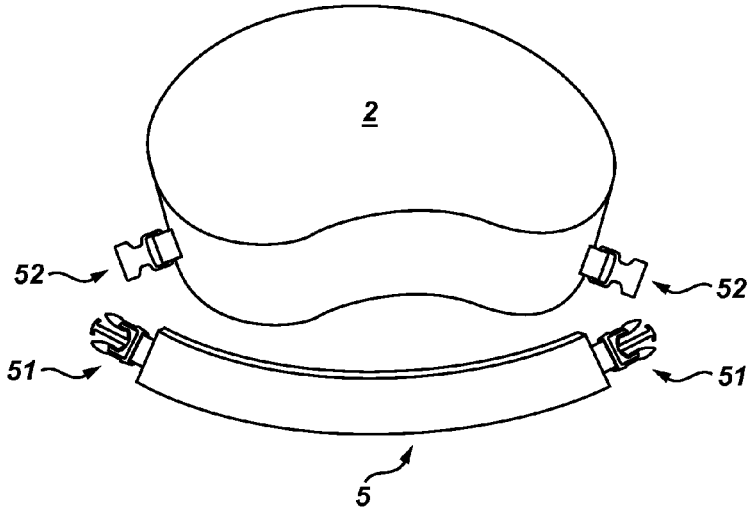
FIG. 7 illustrates an embodiment with a belt to secure the baby-carrying piece around the waist of the caregiver.
Figure 8:
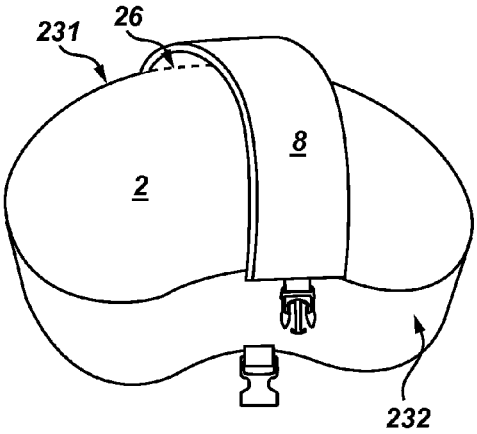
FIG. 8 illustrates an embodiment with a strap mechanism to prevent the baby from rolling off.

Yet another embodiment of the invention has the removable baby-carrying piece 2 (corresponding to the baby-carrying piece 2 of the foregoing embodiments) disposed alongside (as opposed to "inside") the platform piece 1. See FIG. 6. The baby-carrying piece 2 can be larger or smaller than the platform piece 1. FIG. 6 illustrates this embodiment, where the entire baby-carrying piece 2 is larger than the platform piece 1. This implementation would be valuable if the intent is to have a sleeping surface that is significantly smaller than a standard baby mattress, and the baby-carrying piece 2 in fact would constitute the majority of the surface. One example of where this embodiment would be applicable is for baby bassinets, which typically has a much smaller sleeping surface (e.g. a common surface is 30 inches×15 inches), compared to the common sleeping surface of a baby sleeping mattress (37 inches×23 inches or more). In this embodiment, most of the above mentioned features could be applied, such as the slanted shape of the side surfaces 23 of the baby-carrying piece 2 and the side surfaces 66 the platform piece 1 for easy sliding, the contoured shape 24 of the baby-carrying piece 2, the water impenetrable material for both the baby-carrying piece 2 and the platform piece 1*s*, the removable exterior coverings, the thin but firm layer under the baby-carrying piece 2, the baby-carrying piece 2 comprising two pieces, the cutouts 25 in the baby-carrying piece 2, the cutouts 61 in the platform piece 1, the belt 5, the strap mechanism 8 to prevent the baby from rolling over, the choices of fabric, or the flexible flaps 4 on the fitted sheets.

What is claimed is:

1. A combination mattress for babies, comprising:

a platform piece having a top surface, and a recess with a side surface formed from the top surface down; and a removable baby-carrying piece having a top surface, a bottom surface, and a side surface between the top surface and the bottom surface, wherein the baby-carrying piece is capable of fitting closely in the recess of the platform piece such that the top surface of the platform piece and the top surface of the baby-carrying piece are at a substantially same level; and the side surface of the baby-carrying piece is slanted at an angle such that the side surface is increasingly smaller in circumference from the top surface to the bottom surface of the baby-carrying piece.

2. The combination mattress for babies as claimed in claim 1, wherein the platform piece and the baby-carrying piece each comprise a flexible case filled with springs, straws, cottons, downs, feathers, foam rubber, or a combination thereof.

3. The combination mattress for babies as claimed in claim 1, wherein the side surface of the baby-carrying piece has a concave portion, for allowing a caregiver to hold the baby-carrying piece closely towards his or her body via the concave portion, and the side surface of the recess of the platform piece has a convex portion corresponding to the concave portion of the baby-carrying piece.

4. The combination mattress for babies as claimed in claim 1, wherein the platform piece and the baby-carrying piece have a water impenetrable surface.

5. The combination mattress for babies as claimed in claim 1, wherein the top surface of the platform piece is formed of a water impenetrable material and the top surface of the baby-carrying piece is formed of a water impenetrable material.

6. The combination mattress for babies as claimed in claim 1, wherein the platform piece and the baby-carrying piece are each wrapped in a fitted sheet.

7. The combination mattress for babies as claimed in claim 1, wherein the baby-carrying piece comprises a first piece with a recess formed from top down and a removable second piece which is capable of fitting closely in the first piece.

8. The combination mattress for babies as claimed in claim 1, wherein the side surface of the recess of the platform piece or the side surface of the baby-carrying piece is contoured in such a way that two opposite gaps are formed between the side surface of the recess and the side surface of the baby-carrying piece, for allowing a caregiver's hands to access the side surface or the bottom surface of the baby-carrying piece in order to lift the baby-carrying piece from the recess of the platform piece.

9. The combination mattress for babies as claimed in claim 1, further comprising a belt having two ends removably attached to two opposite points, respectively, on the side surface of the baby-carrying piece, for attaching the baby-carrying piece around a caregiver's body.

10. The combination mattress for babies as claimed in claim 1, wherein the side surface of the recess of the platform piece and the side surface of the baby-carrying piece are smooth with each other, for allowing the baby-carrying piece to easily slide in and out of the recess of the platform piece.

11. The combination mattress for babies as claimed in claim 1, wherein the side surface of the recess of the platform piece and the side surface of the baby-carrying piece are coated with polyester.

12. A combination mattress for babies, comprising:

a platform piece having a top surface, and a recess with a side surface formed from the top surface down; and a removable baby-carrying piece having a top surface, a bottom surface, and a side surface between the top surface and the bottom surface, wherein the baby-carrying piece is capable of fitting closely in the recess of the platform piece such that the top surface of the platform piece and the top surface of the baby-carrying piece are at a substantially same level; and a firm layer is formed under the baby-carrying piece.

13. A combination mattress for babies, comprising:

a platform piece having a top surface, and a recess with a side surface formed from the top surface down;

a removable baby-carrying piece having a top surface, a bottom surface, and a side surface between the top surface and the bottom surface; and a strap having one end fixedly attached to the side surface of the baby-carrying piece and another end attachable to an opposite point on the side surface of the baby-carrying piece, for strapping a baby in place on the top surface of the baby-carrying piece, wherein the baby-carrying piece is capable of fitting closely in the recess of the platform piece such that the top surface of the platform piece and the top surface of the baby-carrying piece are at a substantially same level.

14. A combination mattress for babies, comprising:

a platform piece having a top surface, and a recess with a side surface formed from the top surface down; and a removable baby-carrying piece having a top surface, a bottom surface, and a side surface between the top surface and the bottom surface, wherein the baby-carrying piece is capable of fitting closely in the recess of the platform piece such that the top surface of the platform piece and the top surface of the baby-carrying piece are at a substantially same level; and the baby-carrying piece further comprises two flexible flaps extending from the side surface or the top surface of the baby-carrying piece, for allowing a caregiver to lift the baby-carrying piece from the recess of the platform piece via the two flexible flaps.

15. The combination mattress for babies as claimed in claim 14, wherein the two flexible flaps are attachable to the top surface of the platform piece.

16. The combination mattress for babies as claimed in claim 15, where the two flexible flaps are each attachable to the top surface of the platform piece by a hook and loop fastener.

17. A portable sleeping pad for babies, comprising a pad having a top surface, a bottom surface, and a side surface between the top surface and the bottom surface, wherein the side surface of the pad has a concave portion, for allowing a caregiver to hold the pad closely towards his or her body via the concave portion of the pad;

a belt having two ends removably attached to two opposite points, respectively, on the side surface of the pad, for attaching the pad around a caregiver's body, and a strap having one end fixedly attached to the side surface of the pad and another end attachable to an opposite point on the side surface of the pad, for strapping a baby in place on the top surface of the pad.

* * * * *